US006461032B2

(12) United States Patent
McKinley

(10) Patent No.: US 6,461,032 B2
(45) Date of Patent: Oct. 8, 2002

(54) CEILING FAN ILLUMINATION

(76) Inventor: Outon Alfonso McKinley, 1114 W. 149th St., Gardena, CA (US) 90247-3010

( * ) Notice: Subject to any disclaimer, the term of this patent is extended or adjusted under 35 U.S.C. 154(b) by 0 days.

(21) Appl. No.: 09/758,697

(22) Filed: Jan. 11, 2001

(65) Prior Publication Data

US 2001/0030868 A1 Oct. 18, 2001

Related U.S. Application Data

(60) Provisional application No. 60/176,460, filed on Jan. 15, 2000.

(51) Int. Cl.[7] ..... F21V 7/04

(52) U.S. Cl. ..... 362/555; 362/576; 362/148; 362/800; 362/96

(58) Field of Search ..... 362/555, 576, 362/148, 147, 149, 96, 800, 806; 416/5; 392/361

(56) References Cited

U.S. PATENT DOCUMENTS 4,342,073 A * 7/1982 Ranten ..... 362/294
5,082,422 A * 1/1992 Wang ..... 416/5
6,193,384 B1 * 3/1999 Stein ..... 362/96

OTHER PUBLICATIONS

Grainger, "Electronic Message Disply Signs," Grainger Catalog, Grainger, p. 903, (Jan. 11, 1998).

* cited by examiner

*Primary Examiner*—Stephen Husar
*Assistant Examiner*—Bertrand Zeade
(74) *Attorney, Agent, or Firm*—Sanford Astor

(57) ABSTRACT

Applicant's invention comprises adding to a standard ceiling fan assembly an illumination to decorate the fan, comprising an array of light emitting diodes, together with means to adjust the color and array of the light emitting diodes in order to vary the the color or layout of the illumination. Another embodiment of the illumination of the ceiling fan is to provide a message display unit as a part of the fan, circling the fan, in which any message can be displayed.

11 Claims, 2 Drawing Sheets

CEILING FAN ILLUMINATION

This invention is described in my provisional patent application #60/176,460, filed Jan. 15, 2000.

BACKGROUND OF THE INVENTION

Ceiling fans are quite common in businesses, such as restaurants, lounges, retail stores, places of assembly, as well as personal residences. Ceiling fans are installed to aid in the movement of air to keep the environment more comfortable. Many ceiling fans have a light fixture attached as a part of the fan assembly. These lights are standard bulb fixtures, added to add light to the area of the fan.

SUMMARY OF THE INVENTION

Applicant's invention comprises adding to a standard ceiling fan assembly an illumination to decorate the fan, comprising an array of lights, such as light emitting diodes, together with means to adjust the color and on-off arrangement of the array of light emitting diodes in order to vary the the color or layout of the illumination display.

Another embodiment of the illumination of the ceiling fan is to provide a message display unit as a part of the fan, usually circling the fan, in which any message can be displayed. This is particularly useful for places of business, since they can advertise sale items, specials and information about their products or services.

OBJECTS OF THE INVENTION

Accordingly, several objects and advantages of the invention are as follows:

It is an object of the present invention to provide an attractive and decorative illumination as a part of a ceiling fan, which illumination may be varied when desired.

Another object of the invention is to provide a message display illumination, as a part of a ceiling fan, to provide information to those persons in the vicinity of the fan.

These, as well as other objects of the invention, will become obvious from the following description in which:

DETAILED DESCRIPTION OF THE INVENTION

Figure 1:
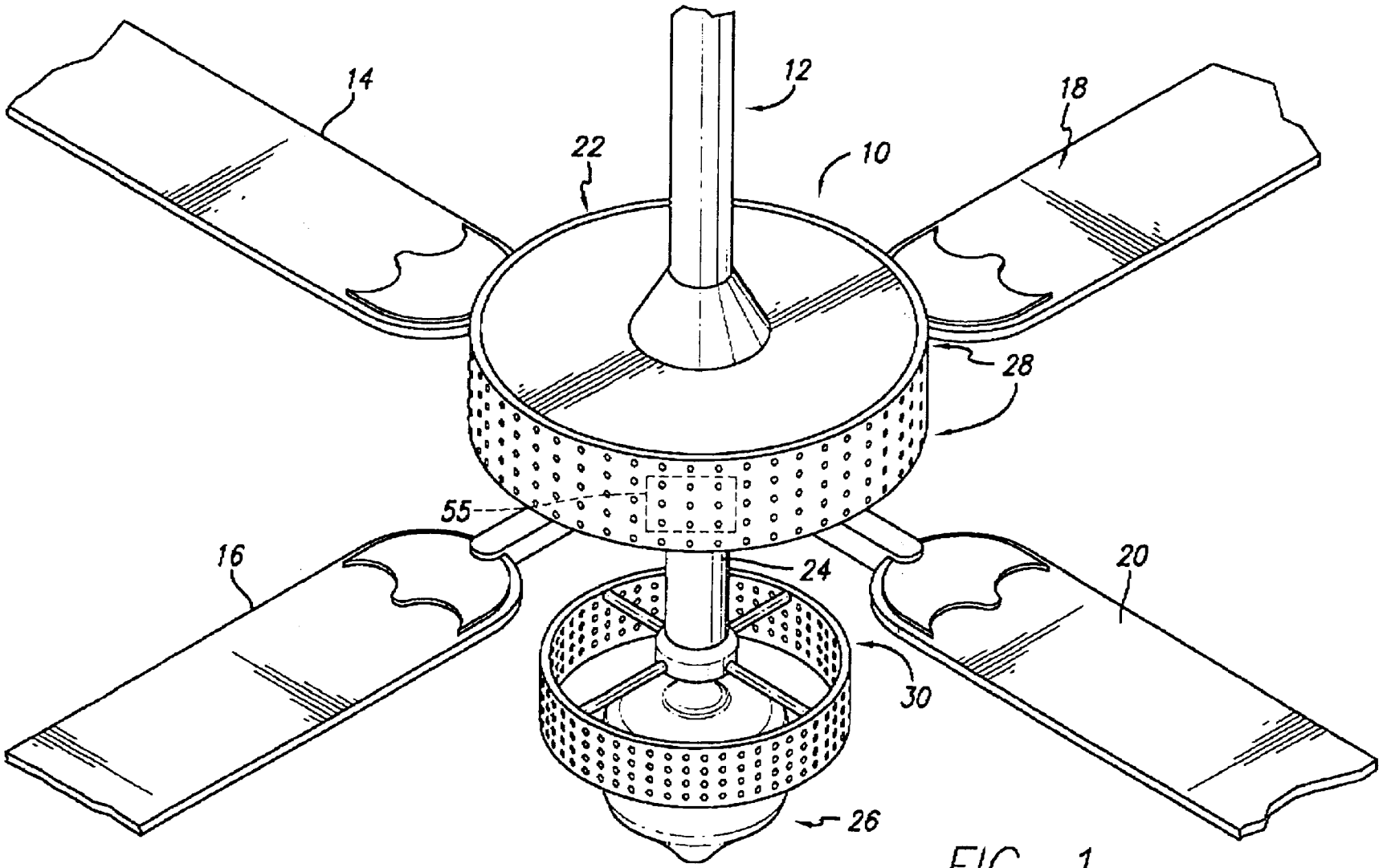
FIG. 1 is a perspective view of a ceiling fan of this invention having a pair of LED arrays.

Referring now to FIG. 1, there is shown a ceiling fan 10 having shaft 12 and fan blades 14, 16, 18, and 20. Motor 22 turns the blades 14–20. Below motor 22 is second shaft 24 which supports lamp 26.

Circling around motor 22 is an array of LEDs 28 (light emitting diodes) electrically connected through shaft 12 as is motor 22. Array of LEDs 28 may be programmed to change colors for different occasions. For instance, the LEDs may be made red, white and blue for the 4th of July, or even a flag can be depicted. For St. Patrick's Day, a field of green clovers could be displayed. Hearts could be displayed for Valentine's Day or Mother's Day. Means for programming the LEDs to any of these displays is well known and can be obtained from various companies, such as Adaptive Micro Systems, Inc.

An additional array of LEDs 30 can be mounted below blades 14–20 above lamp 26 if desired and programmed in the same manner.

Figure 2:
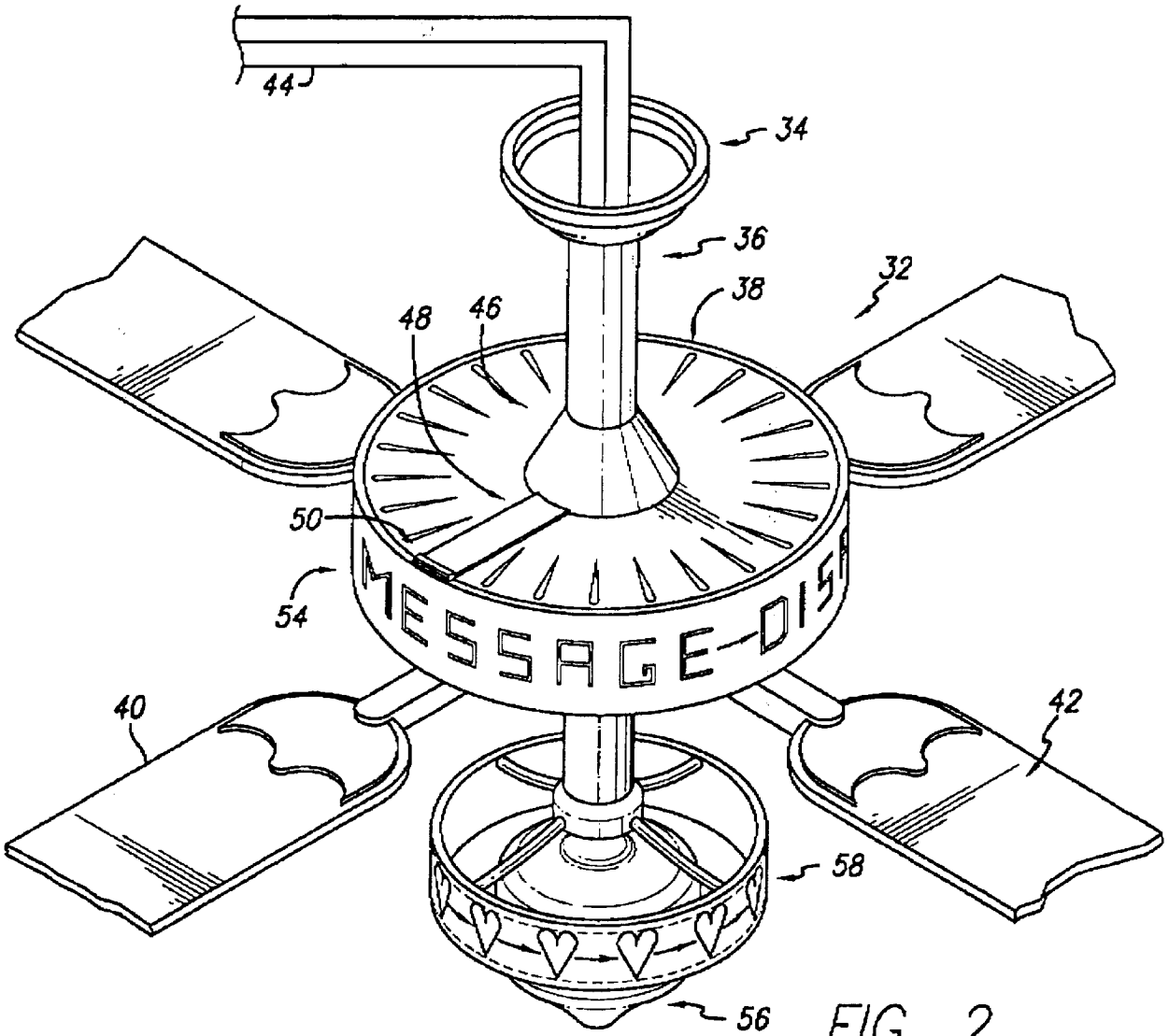
FIG. 2 is perspective view of a ceiling fan of this invention having a message display and a decorative display.

FIG. 2 shows another ceiling fan 32 having mounting hub 34, shaft 36, fan motor 38 and fan blades 40 and 42 (only two blades are shown). Electrical line 44 supplies 120 volt power to the fan unit.

Figure 3:
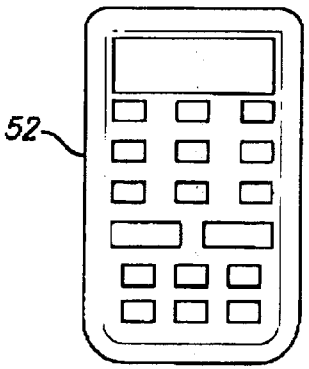
FIG. 3 is front view of a wireless remote programmer used to program the message or display.

A power supply yoke 46, which converts 120 volt power to low voltage DC (direct current) to operate the LED electronic display 54, sits over motor 38. A ribbon cable feeder 48 carries the low voltage DC power to the LED display 54. Ribbon cable feeder 48 attaches to ribbon cable connector 50 which makes the connection to and plugs into LED display 54. A microprocessor based programmable unit inside of LED array 54 is programmed by a wireless remote keyboard control unit 52 (FIG. 3). These microprocesor units for lighting displays are manufactured by Adaptive Micro Systems, Inc. of Milwaukee, Wis.

Instead of an LED array, as shown in FIG. 1, an electronic message display unit 54 circles motor 38, constantly displaying various messages as desired. These message display units are also well known, as manufactured by Adaptive Micro Systems, Inc. They can contain multiple memory files, changeable speeds, and use a wireless, hand-held keyboard 52 for programming.

Below motor 38 is lamp 56, which as in FIG. 1, has a lighting array 58 circling lamp 56. In the alternative, the message display can be placed on the lamp array 58, or both units 54 and 58 can be message display units.

These units add to the ambiance of a restaurant, dining room or hotel conference or party room, or other types of lounges, halls or places of assembly. In any type of retail stores, messages can be displayed about products, sales information, time, date, etc.

In a person's home the LED array can be used to decorate the room for holidays and special occasions.

Having thus described the invention,

I claim:

1. A ceiling fan assembly comprising a motor and a plurality of fan blades, further comprising an array of light emitting diodes attached to and encircling the motor, means to adjust the color and array of the light emitting diodes in order to vary their color and layout.

2. The fan assembly of claim 1 in which the lights comprise a message display.

3. A ceiling fan assembly comprising a motor, a plurality of fan blades and a lamp below the fan blades, further comprising an array of light emitting diodes attached to and encircling the motor, means to adjust the color and array of the light emitting diodes in order to vary their color and layout.

4. The fan assembly of claim 3 in which the light emitting diodes comprise a message display.

5. A ceiling fan assembly comprising a motor, a plurality of fan blades and a lamp below the fan blades, further comprising an array of light emitting diodes encircling the motor, a second array of light emitting diodes encircling the lamp and means to adjust the color and array of the light emitting diodes in order to vary their color and layout.

6. A ceiling fan assembly comprising a motor, a plurality of fan blades and a lamp below the fan blades, further comprising an array of light emitting diodes encircling the motor, a second array of light emitting diodes encircling the lamp and means to adjust the color and array of the light emitting diodes in order to vary their color and layout, in which the light emitting diodes comprise a message display.

7. The fan assembly of claim 3 further comprising a power supply yoke, a ribbon cable feeder and a ribbon cable connector to convert 120 volt power to low voltage direct current to the array.

8. A ceiling fan assembly comprising a motor, a plurality of fan blades and a lamp below the fan blades, further comprising an array of light emitting diodes encircling the motor, further comprising a microprocessor adapted to change the color and layout of the light emitting diode array.

9. The fan assembly of claim 8 further comprising a wireless, remote keyboard to program the microprocessor.

10. The fan assembly of claim 5 in which one of the arrays is a message display unit and the other is a decorative array of light emitting diodes.

11. The fan assembly of claim 5 in which both of the arrays are message display units.

* * * * *